US006411182B1

(12) United States Patent
Song et al.

(10) Patent No.: US 6,411,182 B1
(45) Date of Patent: Jun. 25, 2002

(54) CAVITY RESONATOR FOR REDUCING PHASE NOISE OF VOLTAGE CONTROLLED OSCILLATOR AND METHOD FOR FABRICATING THE SAME

(75) Inventors: Cimoo Song; Chungwoo Kim; Seokjin Kang; Insang Song, all of Yongin; Yongwoo Kwon; Changyul Cheon, both of Seoul, all of (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/540,755

(22) Filed: Mar. 31, 2000

(30) Foreign Application Priority Data

Mar. 31, 1999 (KR) ..... 99-11266

(51) Int. Cl.[7] ..... H01P 7/06
(52) U.S. Cl. ..... 333/219; 333/230
(58) Field of Search ..... 333/219, 204, 333/247, 246, 230

(56) References Cited

U.S. PATENT DOCUMENTS

| | | | | | |
|---|---|---|---|---|---|
| 3,582,833 | A | * | 6/1971 | Kordos | 333/22 R |
| 4,211,987 | A | | 7/1980 | Pan | |
| 4,890,370 | A | * | 1/1990 | Fukuda et al. | 216/2 |
| 5,162,761 | A | * | 11/1992 | Kita et al. | 333/219 |
| 5,635,762 | A | * | 6/1997 | Gamand | 257/728 |
| 5,796,321 | A | * | 8/1998 | Caillat et al. | 333/246 |
| 5,821,836 | A | * | 10/1998 | Katchi et al. | 333/202 |
| 5,990,768 | A | * | 11/1999 | Takahashi et al. | 333/247 |
| 6,225,878 | B1 | * | 5/2001 | Takahashi et al. | 333/204 |

FOREIGN PATENT DOCUMENTS

| | | | | |
|---|---|---|---|---|
| JP | 54-23448 | * | 2/1979 | H01P/1/20 |
| JP | 1-98311 | * | 4/1989 | H03H/3/02 |
| JP | 4-292003 | * | 10/1992 | H01P/7/08 |

OTHER PUBLICATIONS

J. Papapolymerou et al. "A Micromachined High–Q X–Band Resonator", IEEE Microwave and Guided Wave Letters, US, IEEE Inc., New York, vol. 7, No. 6, Jun. 1, 1997, pp. 168–170, XP000690394, ISSN: 1051–8207.

* cited by examiner

*Primary Examiner*—Robert Pascal
*Assistant Examiner*—Dean Takaoka
(74) *Attorney, Agent, or Firm*—Burns, Doane, Swecker & Mathis, L.L.P.

(57) ABSTRACT

A cavity resonator for reducing the phase noise of microwaves or millimeter waves output from a monolithic microwave integrated circuit (MMIC) voltage controlled oscillator (VCO) by using silicon (Si) or a compound semiconductor and a micro electro mechanical system (MEMS), and a method for fabricating the cavity resonator are provided. In the cavity resonator, instead of a conventional metal cavity, a cavity, obtained by finely processing silicon or a compound semiconductor, is coupled to a microstrip line to allow the cavity resonator to be adopted in a reflection type voltage controlled oscillator. A pole is provided to connect the edge of the microstrip line to a predetermined location of a cavity lower thin film. A coupling slot is formed by removing a predetermined width of a cavity upper thin film adjacent to the pole which comes in contact with the cavity upper thin film. A resistive thin film for impedance matching is formed around the cavity lower thin film which comes in contact with the pole. Consequently, the cavity resonator reduces the phase noise of microwaves or millimeter waves which are output from a voltage controlled oscillator.

11 Claims, 5 Drawing Sheets

CAVITY RESONATOR FOR REDUCING PHASE NOISE OF VOLTAGE CONTROLLED OSCILLATOR AND METHOD FOR FABRICATING THE SAME

BACKGROUND OF THE INVENTION

1. Field of the Invention

The present invention relates to a cavity resonator for reducing the phase noise of microwaves or millimeter waves output from a monolithic microwave integrated circuit (MMIC) voltage controlled oscillator (VCO) by using silicon (Si) or a compound semiconductor and a micro electro mechanical system (MEMS), and a method for fabricating the cavity resonator.

2. Description of the Related Art

Conventional MMICs or hybrid VCOs frequently use dielectric disks or transmission lines as resonators. However, dielectic resonators for micro/millimeter waves are very expensive and are difficult to mass produce because the frequency at which resonance occurs depends on the location of the dielectric resonators and it is difficult to specify the location of the dielectric resonators in an MMIC substrate or hybrid VCO substrate. Moreover, the Q-factor of transmission line resonators are too small to reduce phase noise.

SUMMARY OF THE INVENTION

To solve the above problems, it is an objective of the present invention to provide a cavity resonator for reducing the phase noise of a voltage controlled oscillator and a method for fabricating the cavity resonator, wherein, instead of a conventional meal cavity, a cavity which is obtained by finely processing silicon or a compound semiconductor, is combined with a microstrip line to allow the cavity resonator to be used in a reflection type voltage controlled oscillator.

Accordingly, to achieve the above objective, there is provided a cavity resonator for reducing the phase noise of a voltage controlled oscillator. The cavity resonator includes a cavity formed by shaping a semiconductor into a rectangular parallelepiped and plating the surfaces of the rectangular parallelepiped with a conductive thin film. A microstrip line serves as a waveguide at a predetermined distance from the upper thin film of the cavity. A pole couples the end of the microstrip line to a predetermined location of the lower thin film of the cavity. A coupling slot is formed by removing a section, having a predetermined width, of the upper thin film of the cavity. The removed section corresponds to the area of the upper thin film which would come in contact with the pole. A resistive thin film is formed around the part of the lower thin film which comes in contact with the pole, for impedance matching. The conductive thin film, the microstrip line and the metal pole, may be formed of a conductor selected form the group consisting of gold (Au), silver (Ag) and copper (Cu). Preferably, the conductive thin film, the microstrip line and the metal pole, are formed of gold (Au).

There is also provided a method for fabricating a cavity resonator for reducing the phase noise of a voltage controlled oscillator, wherein first, second and third wafers are made to form a metal cavity coupled to a microstrip line via a conductor pole. The method includes the step of forming a microstrip line by depositing chromium (Cr) on one surface of the first wafer, forming a microstrip pattern in the chromium, and plating the microstrip line pattern with gold. An upper metal pole and a cavity upper thin film are formed by forming a via-hole and a coupling slot on the bottom surface of the first wafer, and plating the bottom surface and sidewalls of the via-hole with gold. A cavity lower thin film is formed by depositing chromium (Cr) on the top surface of the third wafer and patterning the chromium to form patterns used for forming an area which will come in contact with the conductor pole and a matching resistor. Then gold plate and a resistive film are deposited on the resultant pattern. The second wafer is bonded to the third wafer. A cavity is formed by etching the second wafer bonded to the third wafer until the cavity lower thin film formed on the third wafer is exposed, while allowing the part of the second wafer corresponding to the lower part of the conductor pole to remain. The metal cavity and a lower metal pole are formed by plating the cavity and the part corresponding to the lower part of the conductor pole with chromium (Cr) and gold (Au). The first wafer is bonded to the exposed surface of the second wafer, which is bonded to the third wafer, such that the metal pole formed in the via-hole of the first wafer is coupled to the lower metal pole formed on the second wafer.

BRIEF DESCRIPTION OF THE DRAWINGS

The above objective and advantages of the present invention will become more apparent by describing in detail preferred embodiments thereof with reference to the attached drawings in which.

DETAILED DESCRIPTION OF THE INVENTION

Figure 1A:
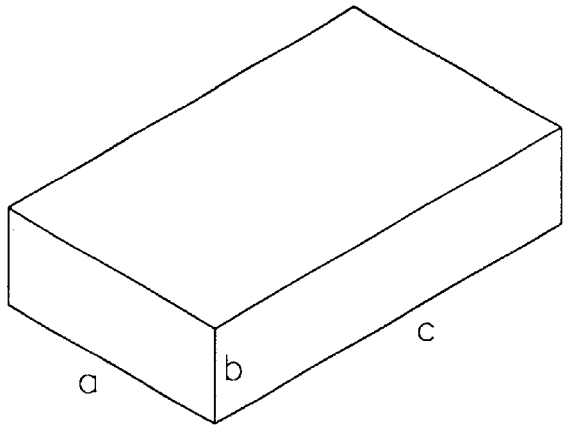
FIG. 1A shows the shape of a cavity which is adopted in a cavity resonator according to the present invention.

The present invention will now be described in greater detail with reference to the accompanying drawings. The same reference numerals or characters in different drawings represent the same element, and thus their description will not be repeated for each drawing.

The phase noise of oscillators is one of the most important factors influencing the performance of transmitting and receiving systems. The resonance frequency of a rectangular parallelepiped metal cavity, as shown in FIG. 1A, is expressed as the following formula. Reference characters a, b and c indicate the width, depth and length, respectively, of the rectangular parallelepiped metal cavity.

$$f_0 = \frac{v_{ph}}{2}\sqrt{\left(\frac{l}{a}\right)^2 + \left(\frac{m}{b}\right)^2 + \left(\frac{n}{c}\right)^2}$$

Here, $V_{ph}$ is a phase velocity inside the cavity and l, m and n are integers indicating resonance modes. There are three kinds of Q factors used for measuring the performance of a cavity. The three Q factors are defined as follows:

unloaded Q ($Q_u$): $Q_u = f_0/\Delta f = (2\pi f_0)W/P_{loss}$ loaded Q ($Q_L$): unloaded Q considering the input and output load external Q ($Q_E$): $1/Q_E = 1/Q_L - 1/Q_U$.

Figure 1B:
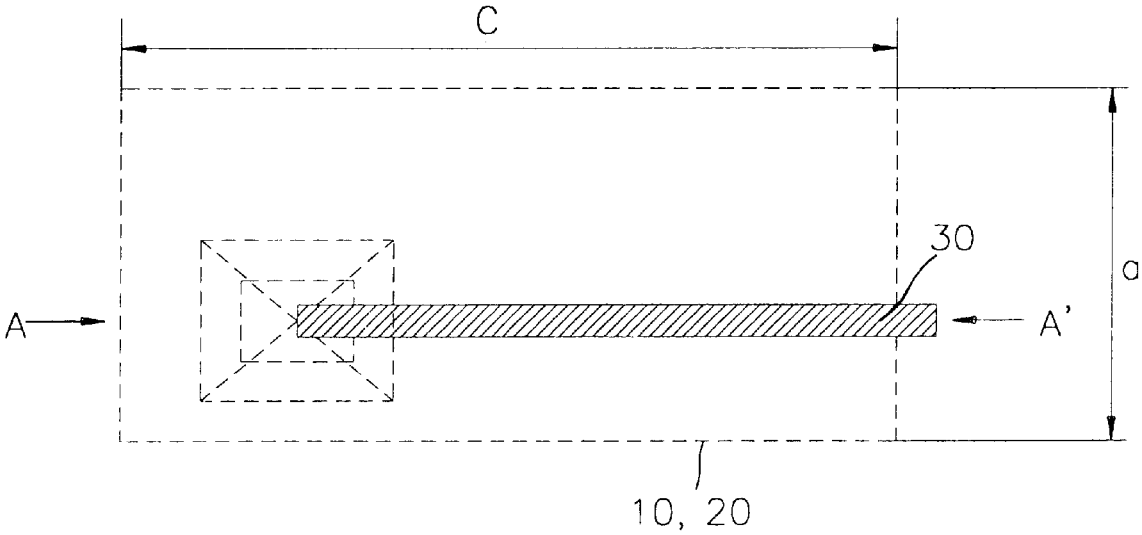
FIGS. 1B and 1C are a plan view and a sectional view, respectively, for showing the schematic structure of a cavity resonator according to the present invention.
Figure 1C:
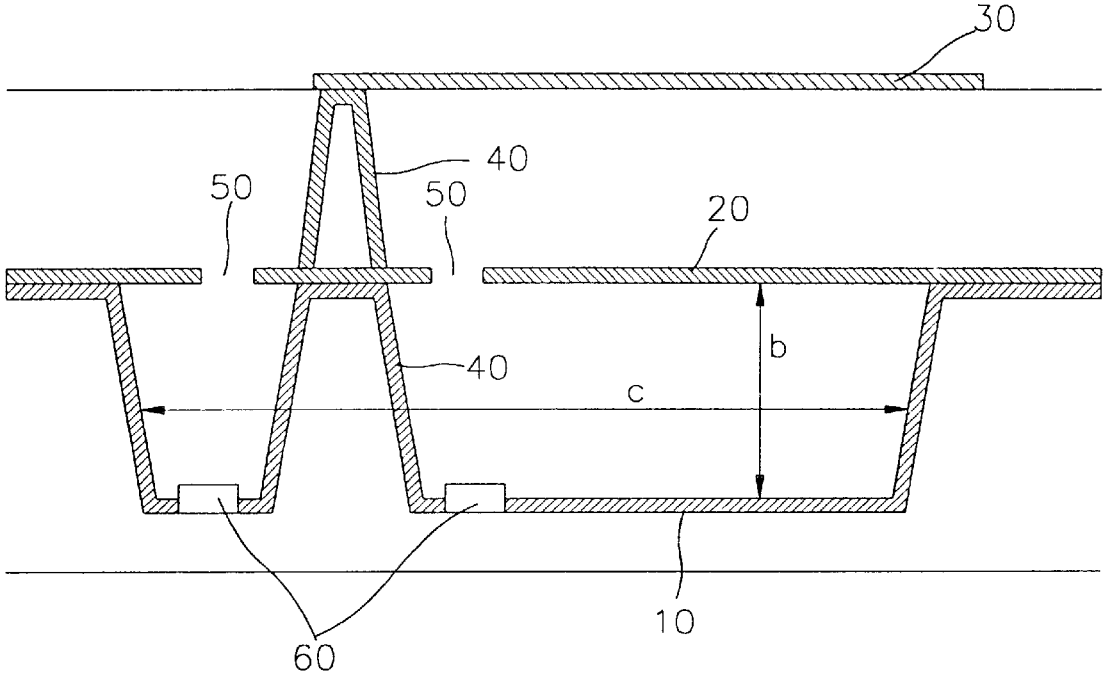

Here, $f_0$ is a resonance frequency, W is stored energy, and $P_{loss}$ is lost energy. Phase noise is inversely proportional to the square of the Q value of a resonator so that a resonator having a large Q value must be used to reduce phase noise. To excite the resonator, electromagnetic wave energy is coupled to the cavity of the resonator using a coaxial cable, a waveguide or a microstrip line, or through an aperture. As shown in FIGS. 1B and 1C, a cavity resonator of the present invention is fabricated using a fine semiconductor processing technology in such a manner that electromagnetic wave energy is coupled to an electric or a magnetic field within a resonator via a microstrip line. In other words, a cavity resonator of the present invention is fabricated using a micro electro mechanical system (MEMS), such that electromagnetic waves of a resonance frequency are totally reflected, and electromagnetic waves of the other frequencies are attenuated by a matching resistor in the cavity resonator.

FIG. 1B is a plan view for showing the schematic structure of the cavity resonator according to the present invention. FIG. 1C is a sectional view taken along the line A—A' of FIG. 1B. In the cavity resonator according to the present invention, instead of a conventional metal cavity, a cavity, which is obtained by finely processing silicon or a compound semiconductor, is combined with a microstrip line to allow the cavity resonator to be adopted in a reflection type voltage controlled oscillator.

Specifically, the cavity resonator for reducing the phase noise of a voltage controlled oscillator according to the present invention, includes a rectangular parallelepiped cavity defined by thin gold (Au) films, and a microstrip line 30 which is formed of a thin gold film to serve as a waveguide at a predetermined distance from a cavity upper thin film 20. The cavity resonator also includes a pole 40 for connecting the end of the microstrip line 30 to a predetermined location of a cavity lower thin film 10 of the cavity. A coupling slot 50 is formed by removing a section having a predetermined width of the cavity upper thin film 20 adjacent to the pole 40 which also comes in contact with the cavity upper thin film 20. A resistive thin film 60 is formed around the cavity lower thin film 10 which comes in contact with the pole 40.

Figure 2A:
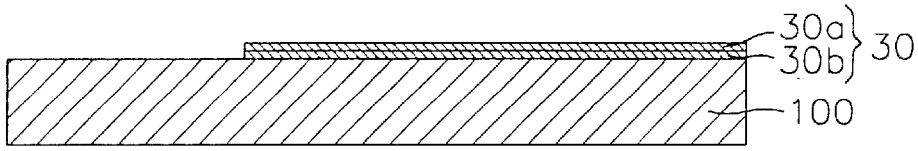
FIGS. 2A through 2G are sectional views for showing the steps of a method for fabricating a cavity resonator according to the present invention.

In the fabrication of the cavity resonator for reducing the phase noise of a voltage controlled oscillator, as shown in FIG. 2A, chromium (Cr) is deposited on the top surface of a first wafer 100 and then patterned to form a microstrip line pattern 30*b*. The microstrip line pattern 30*b* is plated with gold 30*a*, thereby forming the microstrip line 30.

Figure 2B:
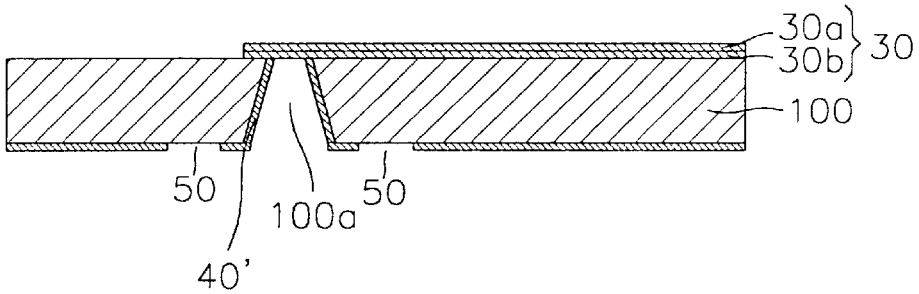

Next, as shown in FIG. 2B, a via-hole 100*a* and a coupling slot 50 are formed on the bottom surface of the first wafer 100. Then, the sidewall of the via-hole 100*a* is plated with gold, thereby forming an upper metal pole 40' in the via-hole 100*a*.

Figure 2C:
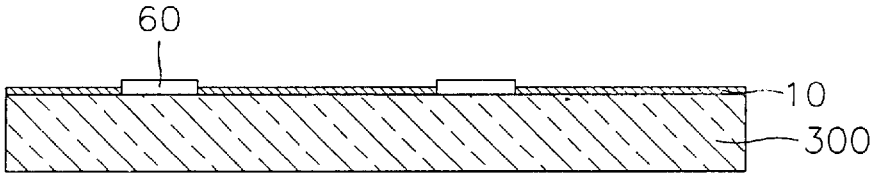

Then, as shown in FIG. 2C, chromium (Cr) is deposited on the top surface of a third wafer 300 and patterned to form patterns used for forming a part 10, which will come in contact with a conductor pole, and a matching resistor 60. Then, gold plate and a resistive thin film are deposited on a resultant structure.

Figure 2D:
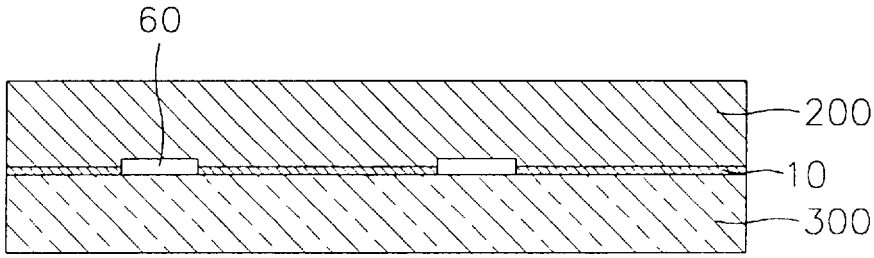
Figure 2E:
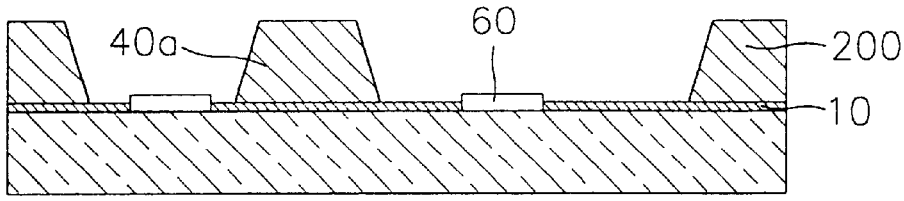

Thereafter, as shown in FIG. 2D, a second wafer 200 is bonded to the third wafer 300. Then, as shown in FIG. 2E, wet or dry etching is performed on the surface of the second wafer 200 until the patterns of the third wafer are exposed, while a part 40*a* of the second wafer 200, which will be a conductor pole, is left, thereby forming a cavity.

Figure 2F:
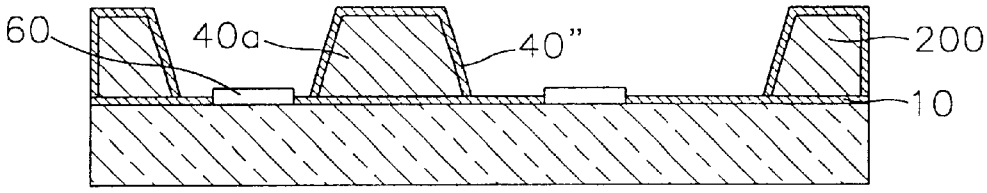

Next, as shown in FIG. 2F, the cavity and the pole 40*a* are plated with chromium (Cr) and gold (Au), thereby forming a metal cavity and a lower metal pole 40".

Figure 2G:
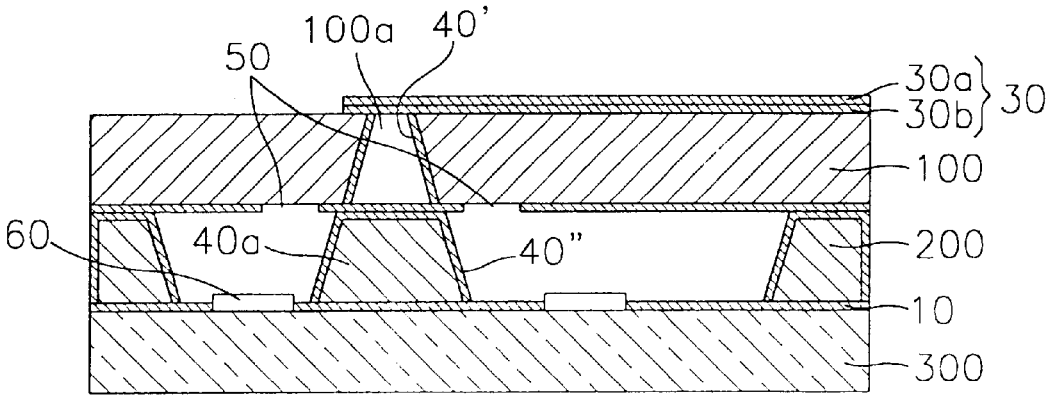

Finally, as shown in FIG. 2G, the first wafer 100 is bonded to the top surface of the second wafer 200, which has been bonded to the third wafer 300, such that the upper metal pole 40', which is formed in the via-hole 100*a*, comes in contact with the lower metal pole 40".

Figure 3:
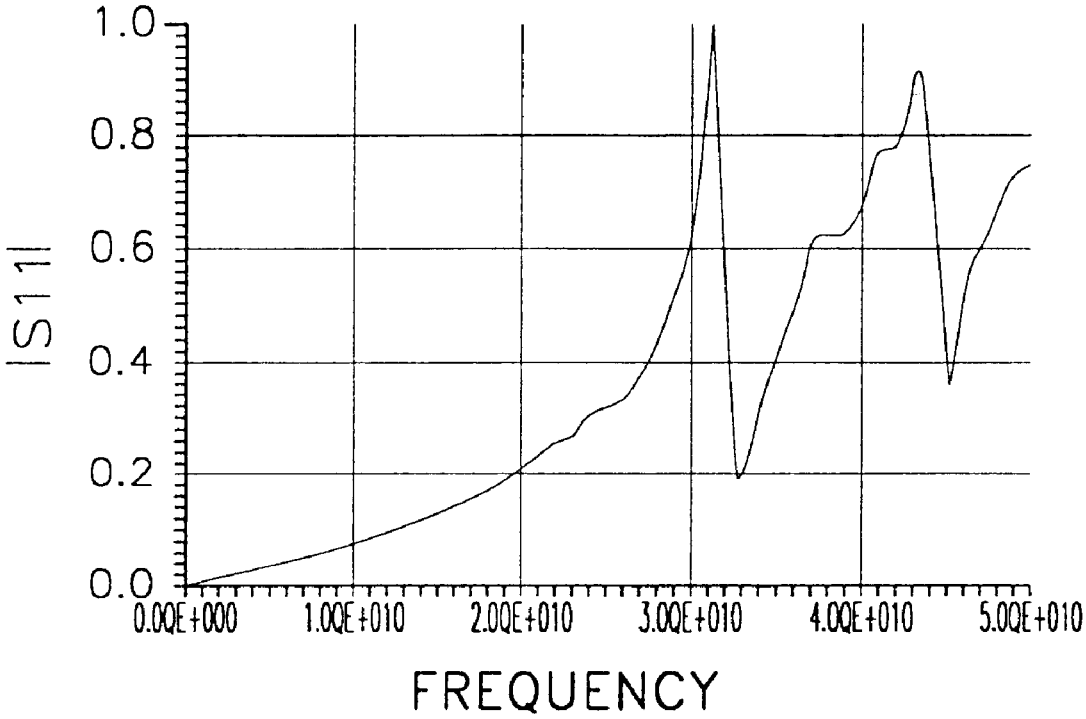
FIG. 3 is a simulated S-parameter of the cavity resonator depicted in FIGS. 1B and 1C.

FIG. 3 shows the characteristic of a simulated parameter S11 of the cavity resonator which is fabricated through the above processes. The simulated resonance frequency is 31.4 GHz and the simulated parameter S11 is approximately 1 at the simulated resonance frequency.

As described above, in a cavity resonator for reducing the phase noise of a voltage controlled oscillator according to the present invention, instead of a conventional metal cavity, a cavity, which is obtained by finely processing silicon or a compound semiconductor, is coupled to a microstrip line to allow the cavity resonator to be adopted in a reflection type voltage controlled oscillator. A pole is provided to connect the edge of the microstrip line to a predetermined location of a cavity lower thin film. A coupling slot is formed by removing a predetermined width of a cavity upper thin film adjacent to the pole which comes in contact with the cavity upper thin film. A resistive thin film for impedance matching is formed around the cavity lower thin film which comes in contact with the pole. Consequently, the cavity resonator of the present invention reduces the phase noise of microwaves or millimeter waves which are output from a voltage controlled oscillator.

What is claimed is:

1. A method for fabricating a cavity resonator, wherein first, second and third wafers are made to form a metal cavity is coupled to a microstrip line via a conductor pole, the method comprising the steps of:

forming a microstrip line by depositing a conductor on the top surface of the first wafer and patterning the conductor to form said micro strip line;

forming an upper metal pole and a cavity upper thin film by forming a via-hole and a coupling slot on the bottom surface of the first wafer, and plating the bottom surface and sidewalls of the via-hole with a second conductor;

forming a cavity lower thin film by depositing a third conductor on a top surface of the third wafer and patterning the third conductor to form patterns used for forming an area which will come in contact with the conductor pole and a matching resistor and depositing a fourth conductor and a resistive film on the resultant pattern;

bonding the second wafer to the third wafer;

forming a cavity by etching the second wafer bonded to the third wafer until the cavity lower thin film formed on the third wafer is exposed, while allowing the part of the second wafer which will be the lower part of the conductor pole to remain;

forming the metal cavity and a lower metal pole by plating the cavity and the part which will be the lower part of the conductor pole with a fifth conductor; and bonding the first wafer to the exposed surface of the second wafer, which is bonded to the third wafer, such that the metal pole formed in the via-hole of the first wafer is coupled to the lower metal pole formed on the second wafer.

2. The method of claim 1, further comprising forming said conductor of said micro strip line by depositing chromium (Cr) on the top surface of said third wafer and pattering said chromium to form said micro strip line, and plating the micro strip line pattern with gold.

3. The method of claim 1, wherein said second conductor is gold.

4. The method of claim 1, wherein said third conductor is chromium (Cr) and the fourth conductor is gold.

5. The method of claim 1, wherein said fifth conductor includes chromium (Cr) and gold (Au).

6. A cavity resonator, the cavity resonator comprising:

a semiconductor having a cavity therein, said cavity being defined by four side surfaces, an upper and a lower surface, each surface being plated with a conductive thin film;

a microstrip line serving as a waveguide and located at a predetermined distance from the conductive thin film on the upper surface of said cavity opposite to said lower surface of said cavity;

a pole electrically coupling an end of said micro strip line to a predetermined location of the conductive thin film on said lower surface of said cavity;

a coupling slot in the conductive thin film on said upper surface of said cavity, said slot having a predetermined width, wherein the location of said coupling slot corresponds to the location of said pole which electrically connects said end of said micro strip line to said the conductive thin film on said lower surface of said cavity; and a resistive thin film formed around the part of the lower thin film which comes in contact with the pole, for impedance matching.

7. The cavity resonator of claim 6, wherein the conductive thin film is formed of a conductor selected from the group consisting of gold (Au), silver (Ag) and copper (Cu).

8. The cavity resonator of claim 6, wherein the microstrip line is formed of a conductor selected from the group consisting of gold (Au), silver (Ag) and copper (Cu).

9. The cavity resonator of claim 6, wherein the pole is formed of gold (Au) or the surface of the pole is plated with gold (Au).

10. The cavity resonator of claim 6, further comprising a semiconductor substrate located between said micro strip line and the conductive thin film on the upper surface, wherein said semiconductor substrate defines said predetermined distance.

11. The cavity resonator of claim 6, wherein said pole includes one section comprised of a conductive thin film on a semiconductor core and another section comprised of a conductive thin film on sides of a via hole.

* * * * *